United States Patent [19]

Thompson, Jr.

[11] Patent Number: 4,478,019

[45] Date of Patent: Oct. 23, 1984

[54] STRUCTURAL FOAM PARTITIONS

[75] Inventor: William A. Thompson, Jr., Toms River, N.J.

[73] Assignee: General Partitions Mfg. Corp., Erie, Pa.

[21] Appl. No.: 311,633

[22] Filed: Oct. 15, 1981

[51] Int. Cl.[3] ..... E04B 2/00

[52] U.S. Cl. ..... 52/239; 52/309.1

[58] Field of Search ..... 52/309.1, 309.4, 239, 52/630, 169.1, 292, 569

[56] References Cited

U.S. PATENT DOCUMENTS

| | | | |
|---|---|---|---|
| D. 257,640 | 12/1980 | Hughey et al. | 52/309.4 |
| 3,182,767 | 5/1965 | Kuehl | 52/593 X |
| 3,220,151 | 11/1965 | Goldman | 52/309.4 X |
| 3,242,619 | 3/1966 | Parsons | 52/64 |
| 3,438,164 | 4/1969 | Duepree | 52/630 X |
| 3,665,668 | 5/1972 | Maddan | 52/593 X |
| 3,875,714 | 4/1975 | Nayler et al. | 52/309.4 |
| 4,189,125 | 2/1980 | Little | 52/309.1 X |
| 4,323,163 | 4/1982 | Johns | 52/593 |

*Primary Examiner*—J. Karl Bell

*Attorney, Agent, or Firm*—Ratner & Prestia

[57] ABSTRACT

A structural foam partition formed by mating identical thin wall panel member halves obtained from the same mold. Panel member halves having molded-in fasteners for mating the panels, molded-in ribs for increasing structural rigidity, and molded-in means to join assembled partitions into restroom enclosures. Alternatively, a structural foam partition with molded-in corrugations to increase structural rigidity.

4 Claims, 18 Drawing Figures

STRUCTURAL FOAM PARTITIONS

BACKGROUND OF THE INVENTION

A. Field of the Invention

This invention relates to the use of structural foam plastic molded into panels of relatively thin cross-section, more particularly to the joining together of such panels to form more rigid partitions to be used in assembling restroom enclosures.

B. Background Art

Metal partitions have been traditionally utilized in the assembly of restroom enclosures. A metal partition is costly to fabricate, is heavy and, therefore, costly to ship, requires the post fabrication addition of hinges and panel joinery hardware, and may deteriorate unless properly maintained.

Metal partitions used in the construction of restroom enclosures range in thickness from one inch to one and one-quarter inches. Molding this thickness in solid structural foam is costly in material and molding-cycle time.

Accordingly, an object of the present invention is the design of plastic panels molded of relatively thin cross-section structural foam that exhibit the structural rigidity of thicker solid panels.

Another object is the molding-in of hinge/lock parts and partition joinery means to minimize post fabrication assembly.

SUMMARY OF THE INVENTION

In an enclosure, a structural foam panel which is formed of a pair of identical, symmetrically molded panel halves each formed from the same mold. Within each panel half is provided molded-in ribs which increase the structural rigidity of the panel. In addition, each panel half has a first and second section divided by an axis of symmetry and molded-in first and second fastening means for the sections. Each first fastening means is spaced from the axis of symmetry a distance equal to the distance that the second fastening means is spaced from the axis of symmetry. The first and second fastening means are adapted to mate with each other. When forming the panel, one of the panel halves is rotated 180° about its axis of symmetry to allow the first and second fastening means of one panel half to mate with the second and first fastening means of the other panel half respectively.

Further, in accordance with the invention, a structural foam panel is provided having rigid corrugations over a major portion of its length. The panel has at least one extended flat section for receiving a flat cover plate to provide a flat mounting area for accessories. The cover plate has ribs for providing structural rigidity for the panel.

DESCRIPTION OF THE PREFERRED EMBODIMENTS

Figure 1:
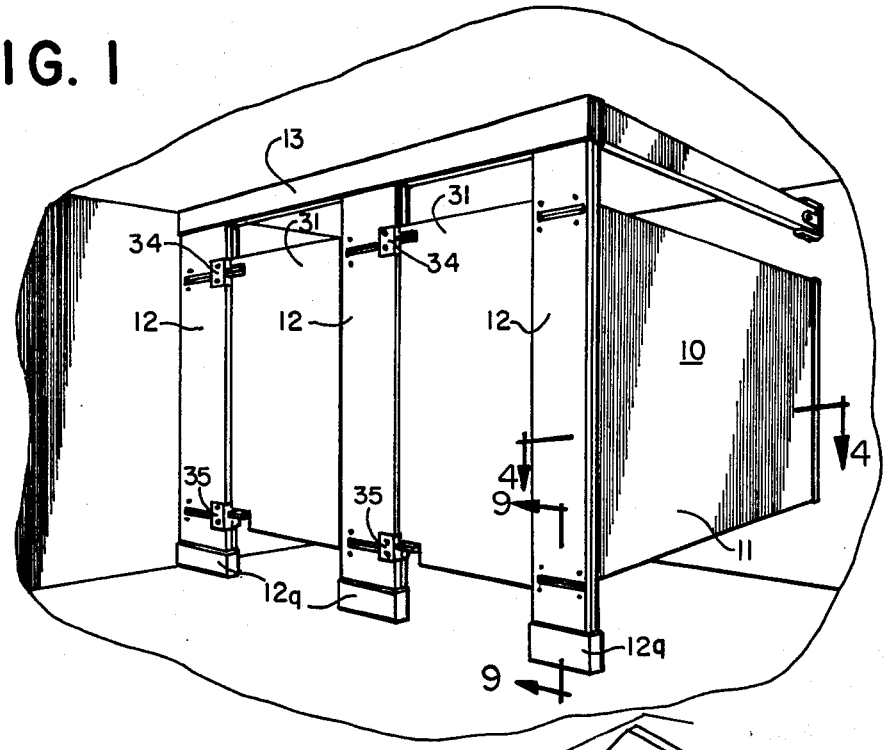
FIG. 1 is a perspective view of one application of the invention wherein two toilet enclosures have been assembled using side panels, pilasters, and doors formed by means of this invention.
Figure 2:
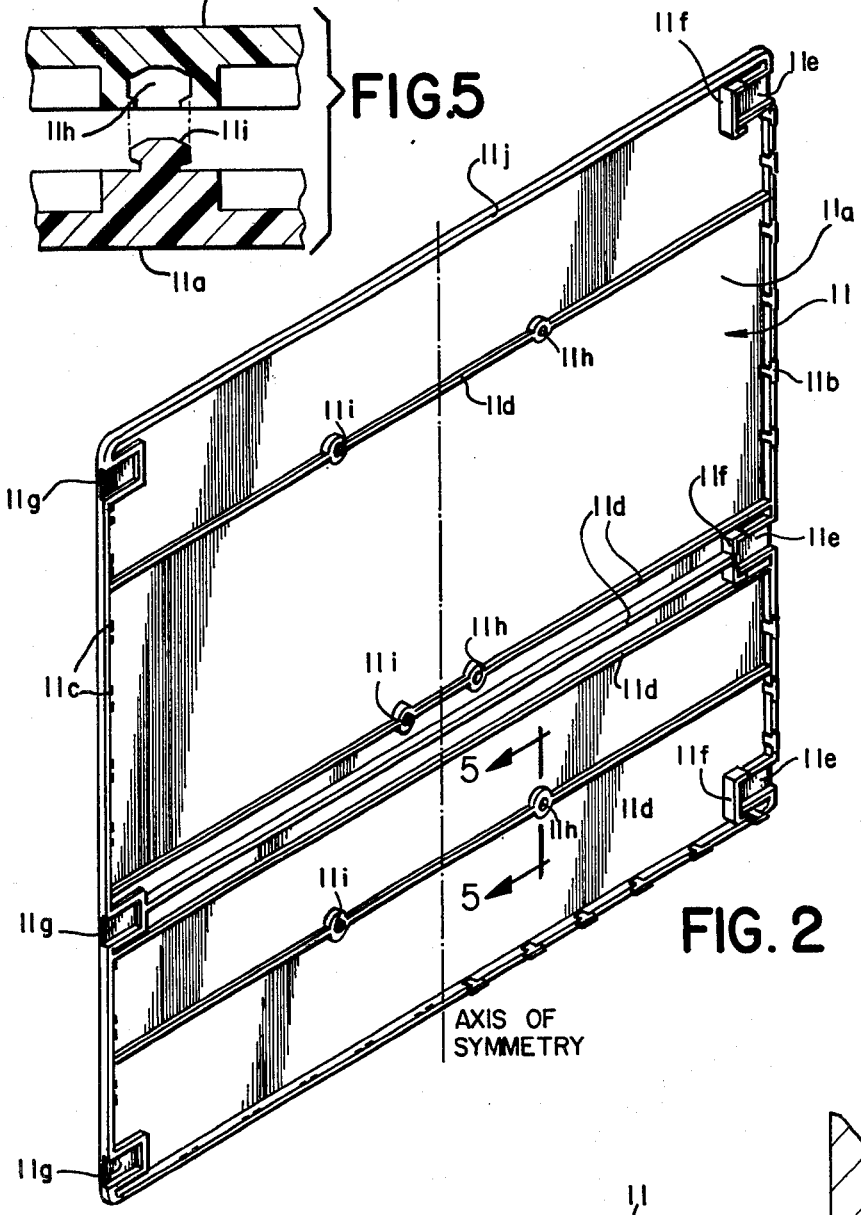
FIG. 2 is a perspective view of a panel member half illustrating the symmetry and fastening means in the preferred embodiment of the invention.
Figure 4:
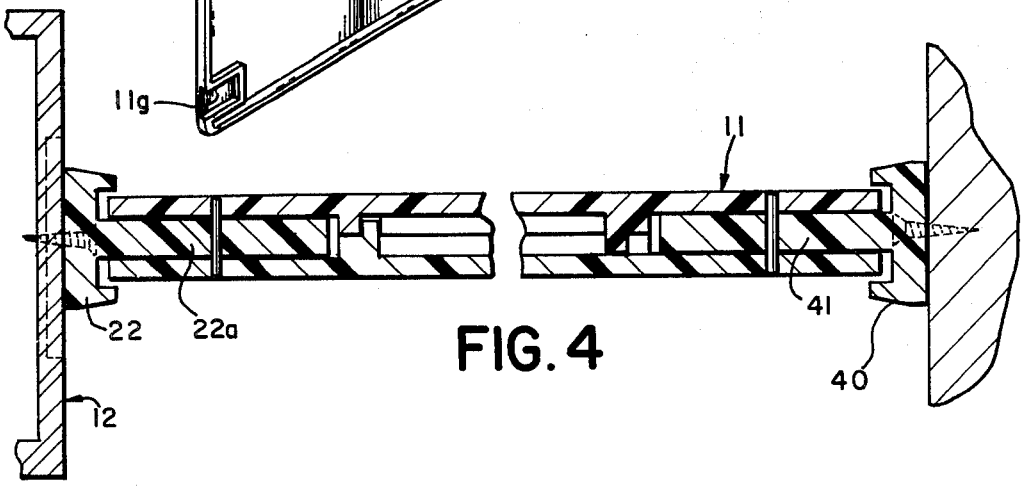
FIG. 4 is a cross-sectional view taken along the line 4—4 of FIG. 1.

Referring to FIG. 1, the structure shown is for use in restrooms, washrooms and the like. Assembly 10 comprises a number of side panels, pilasters and doors as required to enclose a desired number of spaces all molded in structural foam. Side panels 11, doors 31 and pilasters 12 are formed in meeting halves in what will be called here a "hermaphroditic" construction (i.e. using a single mold to form the halves for each panel type) and are snapped together. A side panel half **11*a* is shown in FIG. 2. Side panels are secured to a rear wall by means of molded-in mortises 11*e*, 11*g*, that mate with tenons 41 (FIGS. 4, 15) formed on plates (herein called privacy strips 40) mounted on the wall. Side panels 11 are secured to pilasters 12 via tensons 22*a* in privacy strips 22. Privacy strips 22, 40 fill the gap between panel and pilaster and between panel and wall, respectively, that is undesirably found in most of the prior art. Pilasters 12 are installed between footings 12*e* (FIG. 6) attached to the floor and ceiling brackets 12*j* attached to the ceiling. Alternatively, a headrail 13 (FIG. 10) may be used to join all pilasters together at the top. A serrated staircase 12*d* (FIGS. 6,9) on each pilaster meets with a similar staircase 12*e* on the footing 12*h* to provide vertical adjustment means. If a ceiling bracket 12*j* is used, a similar staircase 12*f* on the top of the pilaster 12 mounts with a complementary one 12*g* on the ceiling bracket to locate the pilaster positively between the ceiling and the floor. The doors 31 are hung by means of hinges 34,35 (FIGS. 6,8**) to the pilaster.

In constructing the side panels, each panel is formed by snapping together two complementary halves **11*a***

Figure 5:
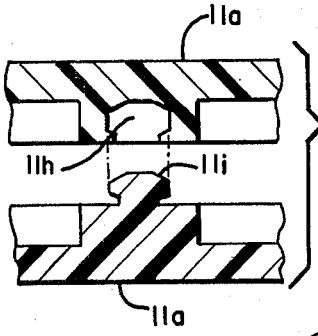
FIG. 5 is a broken cross-sectional view illustrating one of the fastening means used to join panel member halves.

(FIG. 2) each of which has been molded by the structural foam injection method in the same mold. The importance of using a single mold lies principally in the cost savings relative to a conventional two part mold. Another important benefit of the single mold concept is the assurance of a perfect fit of the meeting halves to each other since they are dimensionally fixed by the mold. Using this method, each half is formed in a steel or aluminum mold, as known in the art, with smooth skins on the order of 0.030 to 0.040 thick separated by a structural cellular composition filler. As also known in the art, the outside surface of each half may have a woodgrain or alternate pattern as provided by the mold, or the surface may be porcelainized. As shown on the panel half 11*a* of FIG. 2, on one side of the axis of symmetry are located male locking protuberances 11*i* and on the other side, at corresponding distances, are located opposing female sockets 11*h*. A rim 11*j* is formed about the panel half perimeter. Along the rim 11*j* are located (FIGS. 2,3) molded-in fasteners 11*b* and on the other side of the axis of symmetry at corresponding distances are located mating retainers 11*c*. Also molded-in are ribs 11*d*. In assembling the panel member halves, one half is rotated through 180° about its axis of symmetry and the halves snapped together causing male protuberances 11*i* to lock into opposing female sockets 11*h* and fasteners 11*b* to lock onto corresponding retainers 11*c* (FIG. 5). A fastening means that uses overextended interference between the male and female parts is particularly compatible with structural foam because of its propensity to compress or expand and its memory, which enables it to return to its original state. By using a molded-in fastening means, post-fabrication steps are eliminated (i.e., no bolts, screws, etc. are required).

The strength of a panel assembly is provided by: the outer rim 11*j* of each of the panel member halves 11*a*, the plurality of sockets 11*i*, 11*h* and fasteners 11*b*, 11*c*, and the number of longitudinal ribs 11*d* wherein the ribs of one panel portion are coincident with ribs of the other. Panel members may be constructed of any size with the only requirement being that the panel halves be symmetrical in the sense previously addressed. The ribs (11*d*) as illustrated in FIG. 2 may be formed along a longitudinal dimension to provide strength for mounting accessory items such as: a grab bar, paper holder, sanitary napkin holder, etc. These items may be screwed directly into the ribs since the material of the panel portions is threadable. Alternately, the accessory items may be mounted using bolts passed through both panel member halves.

As stated previously and as shown in FIG. 2, each side panel member half 11*a* includes recesses 11*e*, 11*g* that form blind mortises when two mating halves are snapped together. An overhang 11*f* molded onto the lip of recess 11*e* mates with the lip of recess 11*g* (FIGS. 2,4) and thus acts as an alignment index.

Figure 3:
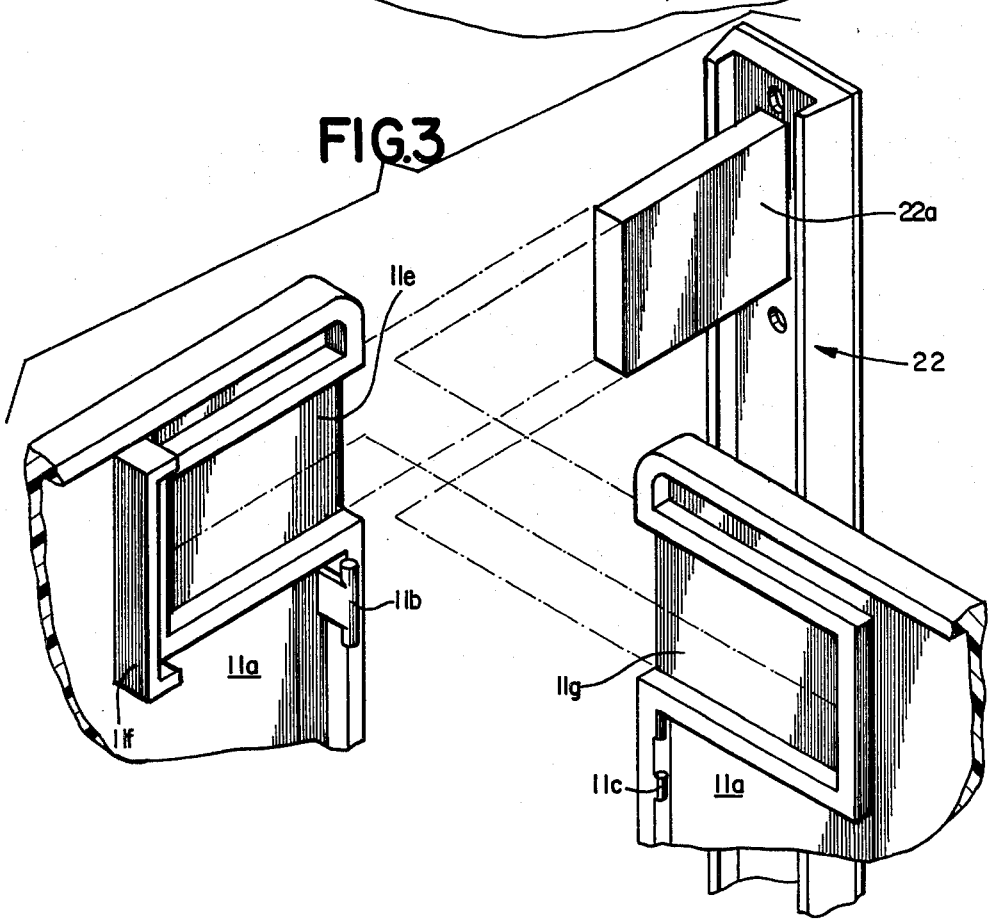
FIG. 3 is an exploded perspective view showing the method used to fasten panel member halves to wall mounting strips.

In FIGS. 6–10, each pilaster 12 consists of two identical halves 12*a* and 12*b* that are locked together with the same type fasteners 12*k* and mating retainers 12*l* first shown in FIG. 3 as fastener 11*b* and mating retainer 11*c*. Horizontal V groove 12*c* provides a positive location for aligning tongue 22*b* of privacy strip 22 as it is attached with bolts to the pilaster 12 to assure proper vertical alignment of side panel 11 with pilaster 12. Horizontal V groove 12*c* also permits privacy strip 22 to be moved horizontally to square up side panel 11 with respect to wall-mounted privacy strip 40. Formed on the inner face of each pilaster half at the bottom is a staircase serration 12*d*. At the top is a similar serration 12*f*. These serrations meet with corresponding serrations 12*e* and 12*g* formed on separate floor mount 12*h* and (when specified) upper ceiling mounting 12*j*, respectively. The serrations provide the ability to move the pilaster vertically relative to the floor and ceiling in order to achieve proper alignment, accommodate minor irregularities in the floor or ceiling, and adjust for varying floor-to-ceiling lights. The serrations do not extend the full width of the pilaster or floor mount, making it possible to move the pilaster offset from the floor mount and ceiling mount in order to achieve the proper vertical position before engaging the serrations, and thus locking the pilaster in position. The pilaster halves are assembled together in a manner similar to that used for the side panels: one mold half 12*b* is rotated about its axis of symmetry through 180° prior to assembly with the other half 12*a*.

Figure 9:
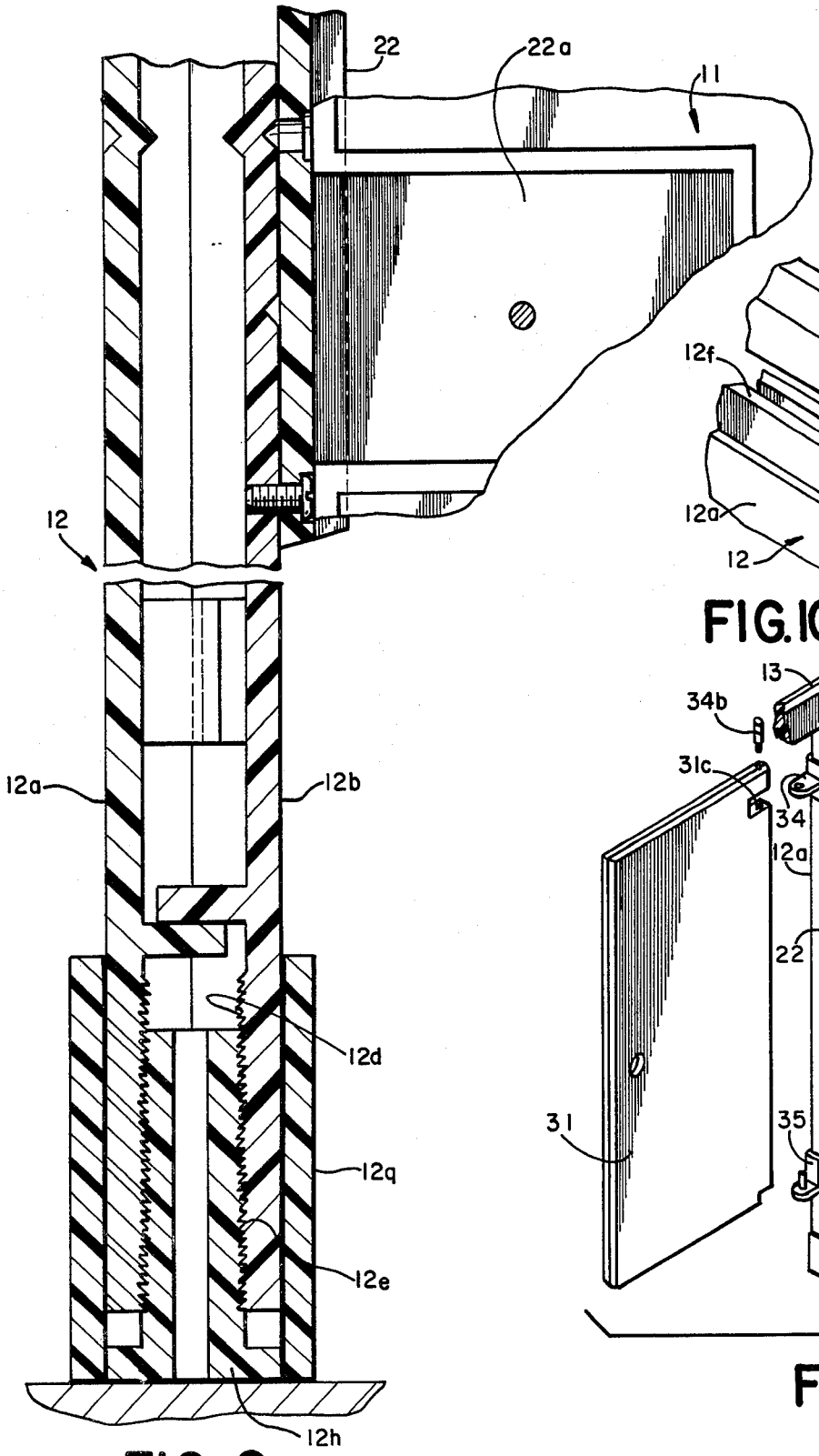
FIG. 9 is a broken cross-sectional view taken along line 9—9 of FIG. 1.
Figure 10:
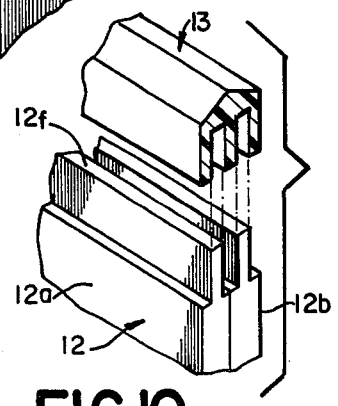
FIG. 10 is an exploded isometric view illustrating the use of a headrail 13 at the top of a pilaster 12 in place of a ceiling mount.
Figure 11:
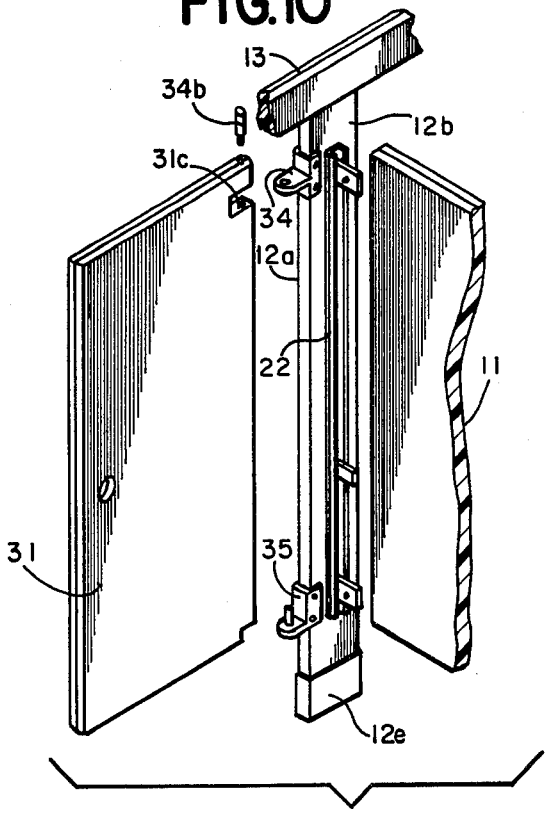
FIG. 11 is an exploded isometric view illustrating both the means by which pilasters are hinged to doors and attached to side panels.

Instead of a ceiling mount, a headrail 13 securing an alternate embodiment of the pilaster 12 to an adjacent wall may be specified (FIG. 10). In this case an extension channel 12*f* is formed at the upper end of the pilaster 12 to meet with the headrail 13 and thereby ensure achievement of a flush, even appearance. In addition a shroud or covering 12*q* acts as a protective cover for floor mount 12*h* (FIG. 9).

Figure 6:
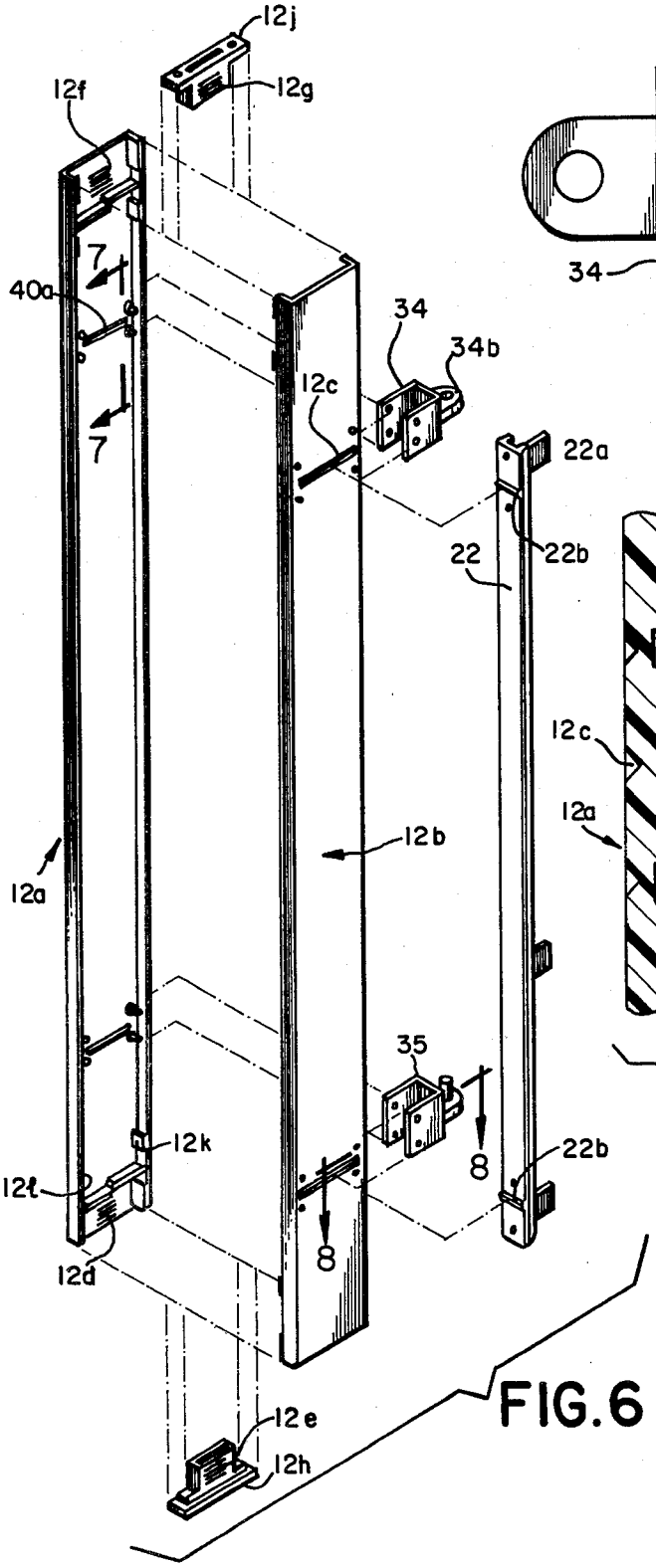
FIG. 6 is an exploded perspective view of a pilaster 12 as shown in FIG. 1.
Figure 8:
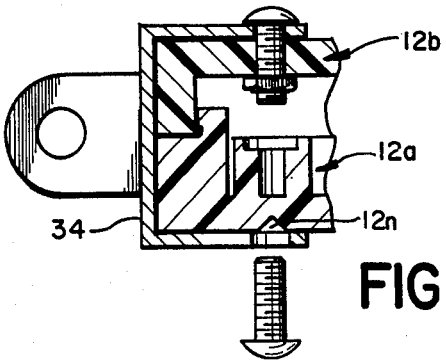
FIG. 8 is a broken cross-sectional view taken along the line 8—8 of FIG. 6.
Figure 7:
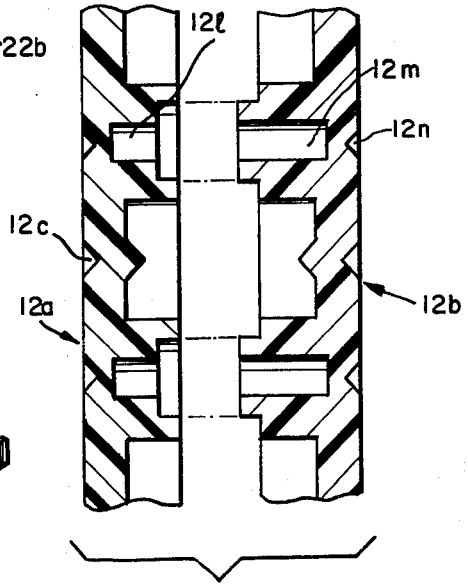
FIG. 7 is a broken cross-sectional view taken along the line 7—7 of FIG. 6.

As shown in FIGS. 6, 7 and 8, door hinge brackets 34 and 35 are mounted at the top and bottom, respectively, of either edge of the pilaster assembly (according to whether doors are hinged on the left or on the right hand side) using bolts inserted through molded-in holes 12*l* and 12*m* which are covered by a thin membrane 12*n*. The molded-in homes assure a true and square assembly: the installer need only break through the thin membrane 12*n*.

Figure 12:
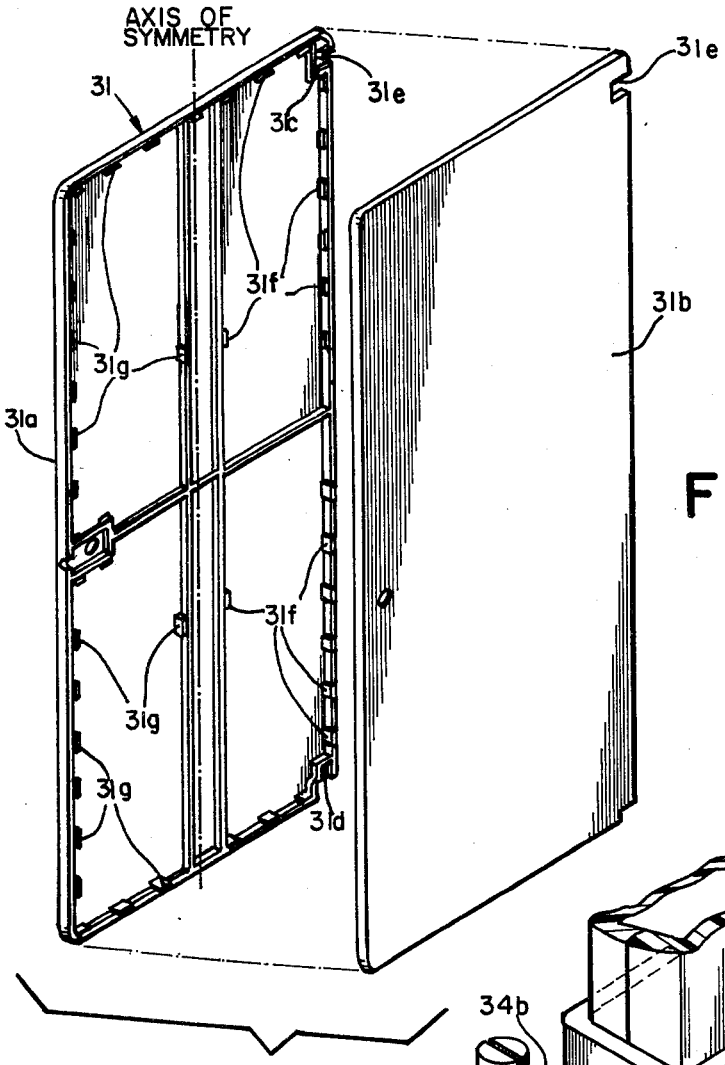
FIG. 12 is an exploded isometric view of a door formed from two door halves.

Design of the door panel 31 (FIG. 12) is similar in most respects to that of the side panel 11. However, the door panel halves 31*a* and 31*b* are not directly interchangeable because the upper hinge section 31*c* is different from the lower hinge section 31*d*. It is therefore necessary to mold the required number of halves of one configuration and then to interchange the upper hinge mold with the lower hinge mold before molding the same number of opposing door panel halves. The other parts of the door are truly complementary, the slot 31*e* for the door latch housing, for example, being located on the horizontal axis of symmetry of the panels. Again, as in the case of the side panel, the door panel 31 is assembled by bringing the meeting halves 31*a* and 31*b* into contact and pressing them together firmly to engage the male snap locks 31*f* located around the periphery and on the inner ribs with their female counterparts 31*g* located at corresponding distances from the axis-of-symmetry.

Figure 13:
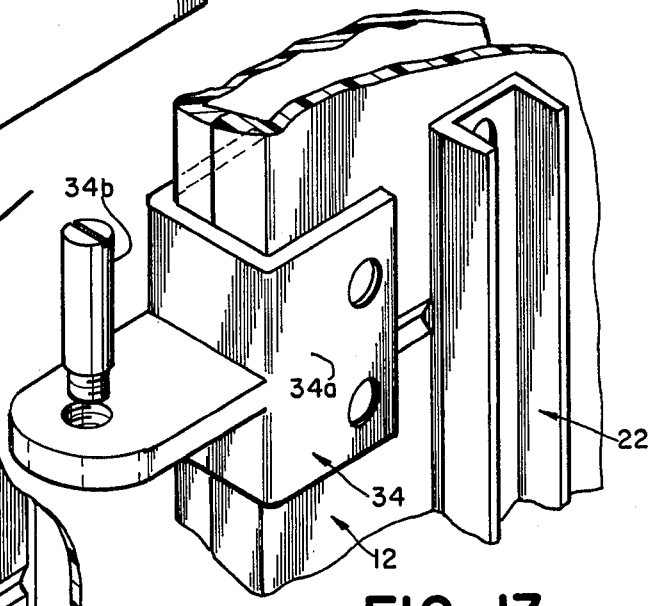
FIG. 13 is a broken isometric view illustrating how an upper door hinge is mounted to a pilaster.
Figure 14:
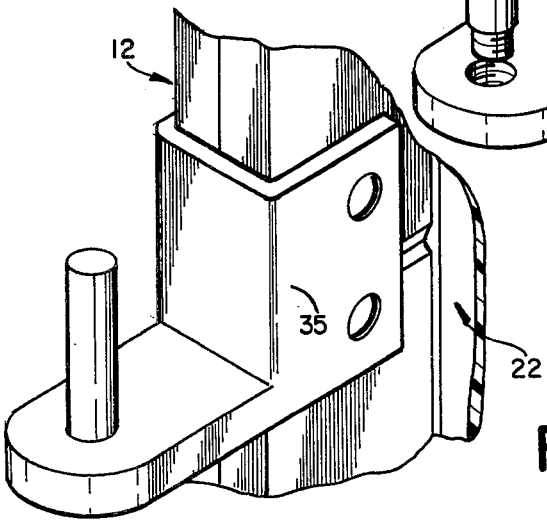
FIG. 14 is a broken isometric view illustrating how a lower door hinge is mounted to a pilaster.

Lower door hinge 35 consists of a pin integral with a bracket mounted on the pilaster (FIG. 14). The hinge pin engages a socket in the lower hinge section 31*d* of the door. The upper hinge 34 employs a detachable hinge pin 34*b* (see FIG. 13) that is inserted from the top edge of the door to engage the hinge bracket 34*a* after the door has been stepped on the lower hinge bracket.

Figure 15:
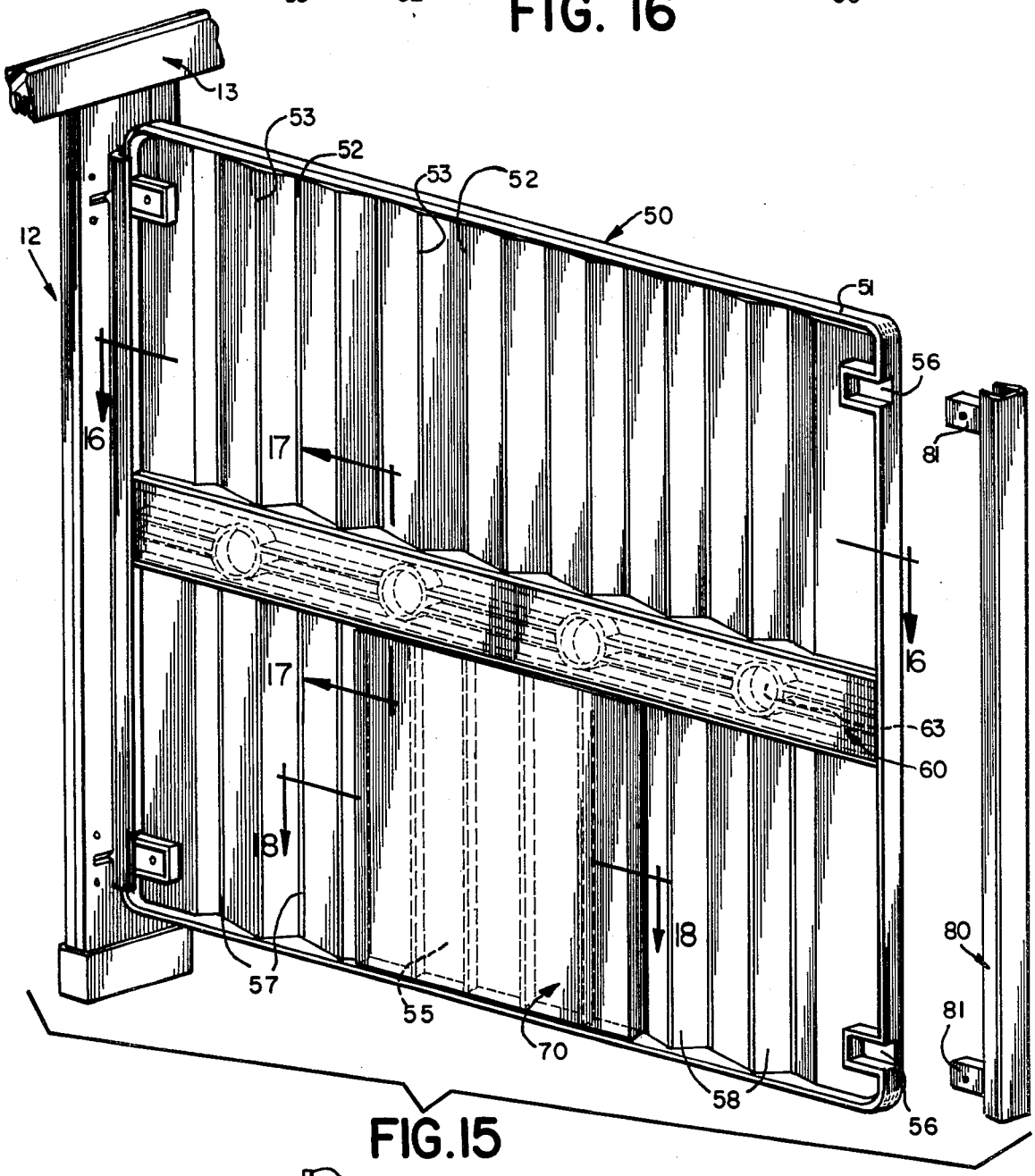
FIG. 15 is an isometric view of an alternate embodiment of the invention in which side panels are formed by molding-in a corrugation pattern.

FIG. 15 contains a variation of the side panel concept previously described. In this embodiment the side panel 50, formed from relatively thin structural foam is a single molded section and derives its rigidity principally from the vertical corrugations 52 (FIG. 16) and the perimeter rim 51. Panel rigidity approaches that a conventional solid panel whose thickness equals the peakto-peak thickness in FIG. 16. This structural stability is obtained even though only up to half the material used in the same thickness solid panel would be required.

Figure 16:
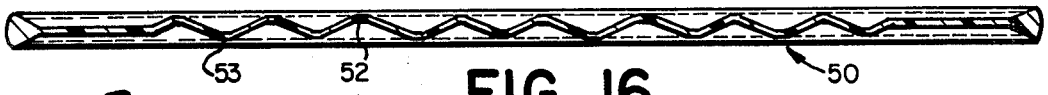
FIG. 16 is a cross-sectional view along line 16—16 of FIG. 15.

In the specific design of FIGS. 15 and 16, the peaks of the vertically oriented corrugation 52 have been molded to form flats 53. The corrugations 52 extend into a vertical flat region 54 formed to provide a mounting area for a paper holder, sanitary napkin holder, etc. A second flat area 55 is formed at the bottom of the panel to provide an additional accessory mounting area.

Side panel 50 also includes vertical corrugation 57 to the left of flat area 55 and vertical corrugation 58 to the right of flat area 55.

Slot 56 formed into corrugated side panel 50 mates with tenon 81 molded into privacy strip 80 (FIG. 15). The tenon 81 can be secured to corrugated side panel 50 by a variety of means including: an adhesive bonding agent, conventional bolt and nut, rivet or self-taping screw. The privacy strip 80 is used to mount the side panel 50 to pilaster 12 and to the wall.

Figure 17:
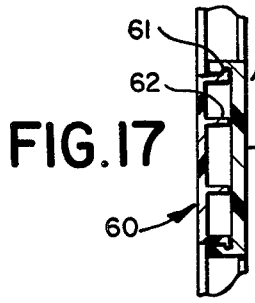
FIG. 17 is a broken cross-sectional view along line 17—17 of FIG. 15.
Figure 18:
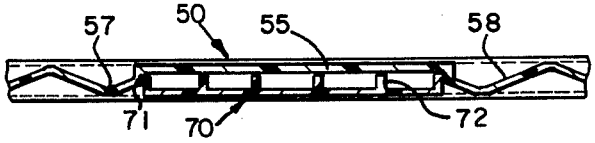
FIG. 18 is a broken cross-sectional view along line 18—18 of FIG. 15.

Two ribbed cover plates 60 and 70 (shown in cross-section in FIGS. 17 and 18) snap into place in a line-to-line fit on corrugated side panel 50 to provide a flat mounting area directly opposite panel flat areas 54 and 55, respectively. The molded-in fastening means at 61, 71 are identical to that used in the hermaphroditic side panel 11 (as illustrated in FIG. 3) where mating fasteners are **11*b* and 11*c*. To accommodate alternate or additional accessory items, cover plate 70 could be extended to the perimeter of the side panel. In these non-corrugated regions of the side panel, structural rigidity is obtained from the ribs 62, 72 formed on the cover plates 60 and 70, respectively, and the box structure created by the cover plates and side panel member 50. As shown in dotted line in FIG. 15, the cover plate 60 horizontal rib design can include circular voids 63** to accommodate accessory item (such as a grab bar) mounting hardware.

What is claimed is:

1. An enclosure formed of structural foam panels, molded pilasters having tenons and a floor mount comprising a pair of identical symmetrically molded panel halves each formed from the same mold, each panel half having a first and second section divided by an axis of symmetry, each panel formed by rotating one of said panel halves 180° about its axis of symmetry, molded-in first and second mortise halves for said first and second sections respectively, each first mortise half being equally spaced from said axis of symmetry as each second mortise half, said first and second mortise halves being adapted to mate with each other to form a full mortise to receive a tenon of said pilaster; and each pilaster having serrations, and said floor mount having corresponding serrations whereby the serrations on said pilaster meet with the floor mount serrations.

2. An enclosure as recited in claim 1 in which said floor mount has sufficient serrations to provide for the vertical alignment of said panel thereby to adjust the height of the panel.

3. An enclosure as recited in claim 2 in which there is provided molded-in first and second fastening means for said first and second sections respectively, each first fastening means being equally spaced from said axis of symmetry as each second fastening means, said first and second fastening means being adapted to mate with each other said first and second fastening means including male locking protuberances and mating female sockets respectively.

4. An enclosure as recited in claims 2 or 3 in which there is provided a rim formed about each panel half perimeter having molded-in fasteners on one side of said axis of symmetry and mating retainers at corresponding distances on the opposite side of said axis of symmetry.

* * * * *